US007339529B2

(12) United States Patent
Martek

(10) Patent No.: US 7,339,529 B2
(45) Date of Patent: Mar. 4, 2008

(54) WIDE BAND BICONICAL ANTENNAS WITH AN INTEGRATED MATCHING SYSTEM

(75) Inventor: Gary A. Martek, Blythewood, SC (US)

(73) Assignee: Shakespeare Company LLC, Greer, SC (US)

( * ) Notice: Subject to any disclaimer, the term of this patent is extended or adjusted under 35 U.S.C. 154(b) by 96 days.

(21) Appl. No.: 11/223,576

(22) Filed: Sep. 9, 2005

(65) Prior Publication Data

US 2006/0017644 A1 Jan. 26, 2006

Related U.S. Application Data

(63) Continuation-in-part of application No. 10/683,063, filed on Oct. 10, 2003, now Pat. No. 7,142,166.

(51) Int. Cl.
*H01Q 1/38* (2006.01)

(52) U.S. Cl. ..... 343/700 MS; 343/795; 343/846

(58) Field of Classification Search ..... 343/700 MS, 343/795, 850, 860, 773, 846, 820, 822
See application file for complete search history.

(56) References Cited

U.S. PATENT DOCUMENTS

| | | | | |
|---|---|---|---|---|
| 2,401,601 A | | 6/1946 | Atwood | 250/11 |
| 2,532,551 A | | 12/1950 | Jarvis | 250/33.63 |
| 2,978,702 A | | 4/1961 | Pakan | 343/753 |
| 4,947,181 A | | 8/1990 | Duncan et al. | 343/773 |
| 5,229,777 A | * | 7/1993 | Doyle | 343/700 MS |
| 5,367,312 A | | 11/1994 | Masters | 343/807 |

(Continued)

FOREIGN PATENT DOCUMENTS

CA 2 307 515 A1 10/2000

(Continued)

OTHER PUBLICATIONS

"*Ultra Broad Band Slant Polarized Omni Azimuthal Antenna*" Proceedings of the Antennas and Propagation Society International Symposium (APSIS) Jun. 28-Jul. 2, 1993, New York, vol. 1, Jun. 28, 1993, pp. 482-485, XP000420084; figs. 2-5.

*Primary Examiner*—Hoang V Nguyen
(74) *Attorney, Agent, or Firm*—Renner Kenner Greive Bobak Taylor & Weber

(57) ABSTRACT

A biconical antenna includes an entry conic having an entry base opposite an entry vertex and a termination conic having a termination base opposite a termination vertex. The entry and termination conics share substantially the same axis and the entry vertex is adjacent the termination vertex. The transmission line is received by the entry conic and terminated in the termination conic. Together, the entry conic and the termination conic phase correct energy emanating from the transmission line. Another embodiment of the antenna comprises an entry conic having at least two sub-conics and a termination conic having at least two sub-conics. Each of the sub-conics having an integer multiple of a half-angle. The biconical antenna may also include a multi-conductor transmission line, wherein the biconical antennas are arranged in a co-linear relationship. Each of the multi-conductors is coupled to at least one of the plurality of biconical antennas. The biconical antennas may also be constructed on a circuit board substrate.

16 Claims, 14 Drawing Sheets

U.S. PATENT DOCUMENTS

| | | | | | |
|---|---|---|---|---|---|
| 5,534,880 | A | | 7/1996 | Button et al. | |
| 5,563,616 | A | * | 10/1996 | Dempsey et al. | 343/753 |
| 5,696,372 | A | * | 12/1997 | Grober et al. | 250/216 |
| 5,767,814 | A | | 6/1998 | Conroy et al. | 343/774 |
| 5,923,299 | A | | 7/1999 | Brown et al. | 343/773 |
| 5,990,845 | A | | 11/1999 | Sharp et al. | 343/846 |
| 6,018,324 | A | | 1/2000 | Kitchener | 343/795 |
| 6,154,182 | A | | 11/2000 | McLean | 343/773 |
| 6,268,834 | B1 | | 7/2001 | Josypenko | 343/773 |
| 6,342,866 | B1 | * | 1/2002 | Ho et al. | 343/795 |
| 6,424,309 | B1 | | 7/2002 | Johnston et al. | 343/767 |
| 6,486,846 | B1 | | 11/2002 | Hart | 343/773 |
| 6,593,892 | B2 | | 7/2003 | Honda | 343/773 |
| 6,667,721 | B1 | | 12/2003 | Simonds | 343/773 |
| 6,864,849 | B2 | | 5/2005 | Hart | 343/773 |
| 7,123,207 | B2 | * | 10/2006 | Yazdandoost et al. | 343/795 |

FOREIGN PATENT DOCUMENTS

| | | | |
|---|---|---|---|
| FR | 867664 | | 11/1941 |
| GB | 649944 | | 2/1951 |
| GB | 1532010 | | 11/1978 |
| GB | 2165097 | A | 4/1986 |
| GB | 1 523 064 | A1 | 4/2005 |
| WO | WO 02/093690 | A1 | 11/2002 |

* cited by examiner

WIDE BAND BICONICAL ANTENNAS WITH AN INTEGRATED MATCHING SYSTEM

CROSS REFERENCE TO RELATED APPLICATION

This application is a continuation-in-part of U.S. patent application Ser. No. 10/683,063 filed Oct. 10, 2003, now U.S. Pat. No. 7,142,166, and entitled Wide Band Biconical Antennas With An Integrated Matching System.

TECHNICAL FIELD

The present invention relates generally to antennas used in mobile and/or military applications. More particularly, the present invention relates to a biconical antenna with an instantaneous bandwidth of about 500-2500 MHz with a relatively low Voltage Standing Wave Ratio (VSWR) and high gain. Specifically, the present invention provides a biconic antenna with a matching system associated with one of the conics and wherein the biconics have a relatively low-angle configuration.

BACKGROUND ART

It is known that electromagnetic communication systems employ broad bandwidth techniques, such as the so-called frequency-agile or frequency-hopping systems in which both the transmitter and receiver rapidly and frequently change communication frequencies within a broad frequency spectrum in a manner known to both units. When operating with such systems, antennas having multiple matching and/or tuning circuits must be switched, whether manually or electronically, with the instantaneous frequency used for communications. As such, there is a need for a single antenna reasonably matched and tuned to all frequencies throughout the broad frequency spectrum of interest.

In a particular frequency range of interest—500-2500 MHz—a short "stubby" dipole antenna has been thought to be a promising antenna construction. These short stubby cylindrical dipoles provide a low length to width ratio for obtaining wide operational bandwidths. Unfortunately, these constructions suffer at the higher operational end of their useful band with natural current nulls and current reversals. This effect is a natural phenomenon of diminishing wavelength with increasing frequency. As a result, the antenna becomes too long for the desired end use. And the reversal currents start to move toward the center of the antenna element as the operating frequency is increased. Additionally, the elevation pattern is adversely effected. When this happens a null or pattern depression is created at 0° elevation. An even further increase in frequency results in an elevation pattern bifurcation.

These undesirable characteristics are evidenced in FIGS. 1-3. In particular, FIG. 1 illustrates a 1,990 MHz dipole antenna from which it can be seen that the higher frequency drops off at the high end band. Moreover, as will be seen in the preferred embodiment, the gain values are insufficient. FIG. 2 also shows that a dipole antenna construction has an undesirable Voltage Standing Wave Ratio at the lower end of the frequency spectrum of interest. Finally, it can be seen in FIG. 3 that the lower frequencies of the spectrum of interest fall out of the desired matching center region. And, it has been found that such a construction does not provide the overall matching, improved electromagnetic energy transferred to and from the antenna, and desirable radiation characteristics over a wide useful range of frequencies.

In view of these shortcomings, there is a need in the art for an antenna that provides improved performance by eliminating current reversals and which does so in a small structural package while still providing all the desirable performance characteristics. There is also a need for an antenna that provides the foregoing desirable characteristics in a two-dimensional configuration.

SUMMARY OF THE INVENTION

It is thus an object of the present invention to provide wide band biconical antennas with an integrated matching system.

Another object of the present invention, which shall become apparent as the detailed description proceeds, is achieved by an antenna comprising a transmission line, an entry conic having an entry base opposite an entry vertex, a termination conic having a termination base opposite a termination vertex, said entry and termination conics sharing substantially the same axis, said entry vertex adjacent said termination vertex, and wherein said transmission line is axially aligned with said entry conic and terminated at said termination conic, said entry conic and said termination conic phase correcting energy emanating from said transmission line.

Still another object of the present invention is an antenna comprising a non-conductive substrate having a conic side opposite a transmission side, a transmission line disposed on said transmission side, and at least two conics disposed on said conic side and spaced apart from each other, said transmission line disposed within a ground plane formed by one of said conics and connected at an end to one of the other of said conics.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 4:
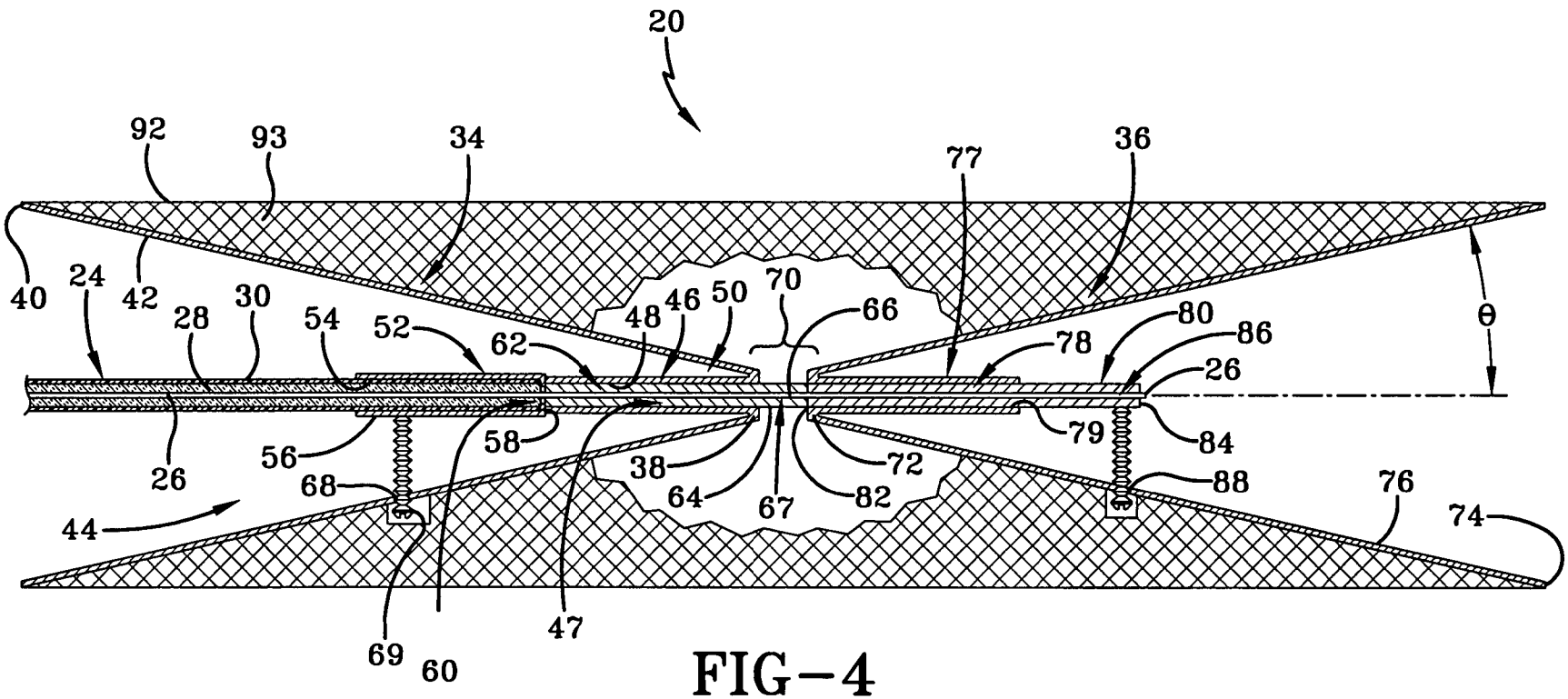
FIG. 4 is a cross-sectional elevational view of a biconical antenna with a transmission system, shown in FIG. 4A, made according to the concepts of the present invention.
Figure 4A:
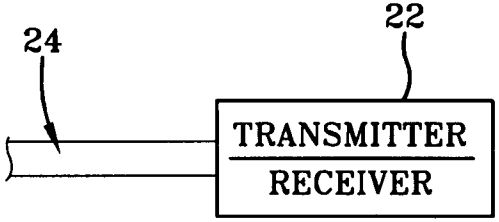

Referring now to the drawings and, in particular to FIGS. 4 and 4A, a wide band biconical antenna made according to the present invention is designated generally by the numeral 20. The antenna 20 is connected to a transmitter/receiver system 22 which may be carried by an individual or vehicle for the purpose of communicating with others. It will be appreciated that the antenna of the preferred embodiment may be employed for ground-to-ground or ground-to-air communications and even potentially satellite communications with asymmetrical conic sections.

The transmitter/receiver 22 is connected to the antenna 20 by a transmission line 24. In the preferred embodiment, the transmission line is a 50 ohm coaxial cable, one end of which extends into the antenna 20 and is terminated in a manner to be discussed in detail. The transmission line 24 includes a center conductor 26 that is surrounded by a dielectric insulation material 28. A conductive shield 30, which is preferably a solid tubular copper walled configuration, (commonly referred to as "semi-flex") but which could also be any other shielding type construction, surrounds the insulation material 28.

The biconical antenna 20 includes an entry conic 34 which is positioned adjacent to a termination conic 36. It will be appreciated that the narrow ends or vertices of the conics are positioned adjacent one another and that the conics preferably share the same axis. And it will be apparent that the conics 34 and 36 are actually a frusto-conical construction.

The entry conic 34 includes an entry vertex 38 at one end of the conic opposite an entry base 40. A wall 42 extends from the vertex 38 to the base 40. The wall 42 forms an interior cavity 44 for receiving the transmission line 24. It will be appreciated that the cavity is open so as to receive the transmission line 24 and allow for selected components of the transmission line to extend out from the vertex 38. An entry eyelet 46 may be provided at the entry vertex 38 so as to provide structural support in that area and to allow for passage of selected transmission line components. The eyelet 46 extends axially inwardly from the vertex 38 a predetermined distance. The eyelet 46 is contiguous with the wall 42, although the eyelet 46 could be a separate tubular construction. The eyelet provides an axial opening 47 formed by a conductive interior surface 48. As used herein, the term eyelet is taken to mean a tubular metal construction having an axial hole therethrough.

In this embodiment, both conics 34 and 36 are a deep drawn brass material. However, it will be appreciated that other metallic materials could be used for the conics and indeed that a metallized flexible member in a conic shape could be utilized for the conic's construction. The conics ideally have a half-angle of 9° plus or minus 2°. As seen in the drawing, the half-angle is designated by the symbol θ. The benefits of this relatively smaller half-angle value will be discussed in detail below.

A matching system, which is designated generally by the numeral 50, may be received in the interior cavity 44 for the purpose of transforming the impedance of the transmission line 24 to a desired value. In the preferred embodiment the transmission line impedance of 50 ohms is matched to a impedance of anywhere from 150 to 300 ohms depending upon the desired bandwidth of the antenna. The amount of transformation is dictated by the construction—dimensions and materials—of the matching system 50. The matching system 50 includes the cylindrical eyelet 46, created by the conductive interior surface 48 and a dielectric insulator 62 which is received in the axial opening 47 and which encompasses the center conductor 26. Below the matching system 50, is a conductive sleeve 52 which provides an interior surface 54 and exterior surface 56. At the end of the sleeve 52 closest to the end of the eyelet 46 further from the vertex 38, the sleeve 52 provides an inwardly extending collar 58. The interior surface 54 and the collar 58 form an axial hole 60 that extends through the entire sleeve 52.

The transmission line 24 is prepared such that the outer shield 30 and dielectric insulation material 28 are removed and a significant length of the center conductor 26 is exposed. The transmission line 24 is inserted into the sleeve 52 so as to allow for the inwardly extending collar 58 to make electrical and mechanical contact with the conductive shield 30. A small portion of the insulation 28 and the exposed length of the center conductor 26 is received within the dielectric insulator 62 that is positioned between the end of the sleeve 52 and the termination conic 36, and within the eyelet 46. In other words, the tubular insulator 62 extends through the axial opening 47 with one end of the insulator 62 abutting the collar 58 and the other end abutting the vertex of the termination conic 36. The insulator sleeve 62 is preferably made of a dielectric material such as polyethylene or any suitable dielectric material chosen for low loss and tuning characteristics. The insulator 62 includes an exterior surface 64 and an interior surface 66 which forms an insulator hole 67 that axially extends to the vertex of the terminal conic 36. Accordingly, the center conductor 26 is received within the insulator hole 67 and is thus prevented from making any mechanical or electrical contact with any portion of the entry conic 34.

The transmission line 24 and sleeve 52 are concentrically maintained in the entry conic by use of a set screw 69. Extending through the wall 42 is a set screw hole 68 that is aligned with the exterior wall 56. The set screw 69 is received in the set screw hole 68 and is radially adjusted so as to contact the exterior wall 56 to maintain a position of the transmission line 24 and the sleeve 52 within the entry conic. It will be appreciated that the length and the inner and outer diameters of both the eyelet 46 and the insulator 62 and the material that it is constructed from may be adjusted or "tuned" so as to provide the desired matching impedance between the transmission line and the antenna. The length of both the eyelet 46 and the insulator sleeve 62 are accommodated by repositioning transmission line 24 and sleeve 52 via set screw 69 during the tuning process.

The integrated matching system 50 is established for the purpose of efficient energy transfer from the source (the transmitter) to the load (the antenna). In the preferred embodiment, an antenna can be matched from f1, (frequency minus 1) to 5*f1 the transmission line, which is designed to the geometric mean of the gap impedance and a typical 50 ohm transmission line from the source. The design length is derived from the geometric mean created by f1 and 5*f1. This geometric mean frequency is then divided into the free space velocity of light to which one half this value (a dipole) is used to set the physical length of the antenna element. An arc struck by a line formed by the coaxial/longitudinal axis and the center of the antenna which acts as a vertex, is scribed to create the desired 9° half-angle configuration. The resulting arc is revolved about the longitudinal axis to produce the characteristic conic configuration for both the entry conic and the termination conic. The insulator 62 extends outwardly from the entry conic and comes in contact with the termination conic 36 thus forming a voltage gap 70 between the conics. This voltage gap is necessary to complete the transforming of the contained coaxial TEM01 mode of guided wave energy into the launch of the reactive-near field and radiating near-fields of the antenna.

The termination conic 36 is constructed in much the same manner as the entry conic except that a matching system is not provided within the interior of the conic, but instead a mechanical cap 80 is employed. The termination conic 36 includes a termination vertex 72 which is positioned adjacent the entry conic vertex. The opposite end of the termination conic vertex 72 is a termination base 74 wherein a termination wall 76 extends between the vertex and the base. The termination wall 76 is also made of a brass material and utilizes substantially the same half-angle as the entry conic. A termination eyelet 77 may be provided at the termination vertex 72 for the purpose of supporting an end of the insulator 62 and the cap 80. The termination eyelet 77 extends axially into the conic 36 from the vertex 72 a predetermined distance. The eyelet 77 is contiguous with the wall 76, although the eyelet could be a separate tubular construction. The eyelet 77 provides an axial opening 78 formed by a conductive interior surface 79.

The cap 80 includes an eyelet end 82 opposite a distal end 84. Axially extending through the cap 80 is a cap hole 86 which receives the center conductor 26. The center conductor 26 may be soldered or electrically terminated at the eyelet end 82. Preferably, the center conductor 26 extends all the way through the axial hole 86 and extends out the distal end 84 where it may or may not be electrically or mechanically terminated to the wall 76. The cap 80, which is preferably of a brass construction, provides a length and wall thickness that may be dimensionally adjusted for further turning of the antenna. The termination wall 76 has a set screw hole 88 extending therethrough to allow for the receipt of a screw 90 which is screwed a certain depth into the conic so as to maintain the desired concentricity of the cap 80 with respect to the termination conic. The entire biconical antenna 20 may be enclosed and sealed within a radome 92 which receives and protects the entire assembly. A foam material 93 may receive and protect the antenna 20 within the radome 92.

In evaluation of the biconical antenna it has been found that the ratio of the conic's end diameter over the diameter created by the conic's truncation at the vertices 38 and 72 is found to be quite important. The truncation of the conic at the vertex is a necessary result of providing the voltage gap and sizing of the insulator with respect to the termination conic 36. The diameter of the vertices is further dictated by the electrode's diameter at the voltage gap which has to be large enough to accommodate the necessary outer conducting radius to establish the geometric mean impedance for the matching system's transition. Thus a ratio of the conic's outer circles—at base 40 and 74—to the conic's truncated circle—at vertices 38 and 72—can be set to a ratio. Ratios in the range of $D1/D2 \geqq 5.0$, where D1 is the "end-diameter" and D2 is the "vertex diameter" may be utilized. It has been observed that the greater this ratio, the better the operating band VSWR especially at lower frequencies is obtained. This ratio has a practical limit driven by the necessary electrode diameters and matching system requirements as well as the design power rating for the antenna. Thus, a high power design goal would drive this ratio to be lower and thus cause a lower low band end frequency match. Experience with adjusting the matching system requirements and the size parameters of the entry conic and termination conic has shown that the present invention can be nearly matched over its design bandwidth of 5*f1 with a simple one stage coaxial transition. This simple matching system 50 enjoys low insertion loss from otherwise more traditional "higher-order" approaches with more lossy components.

Figure 1:
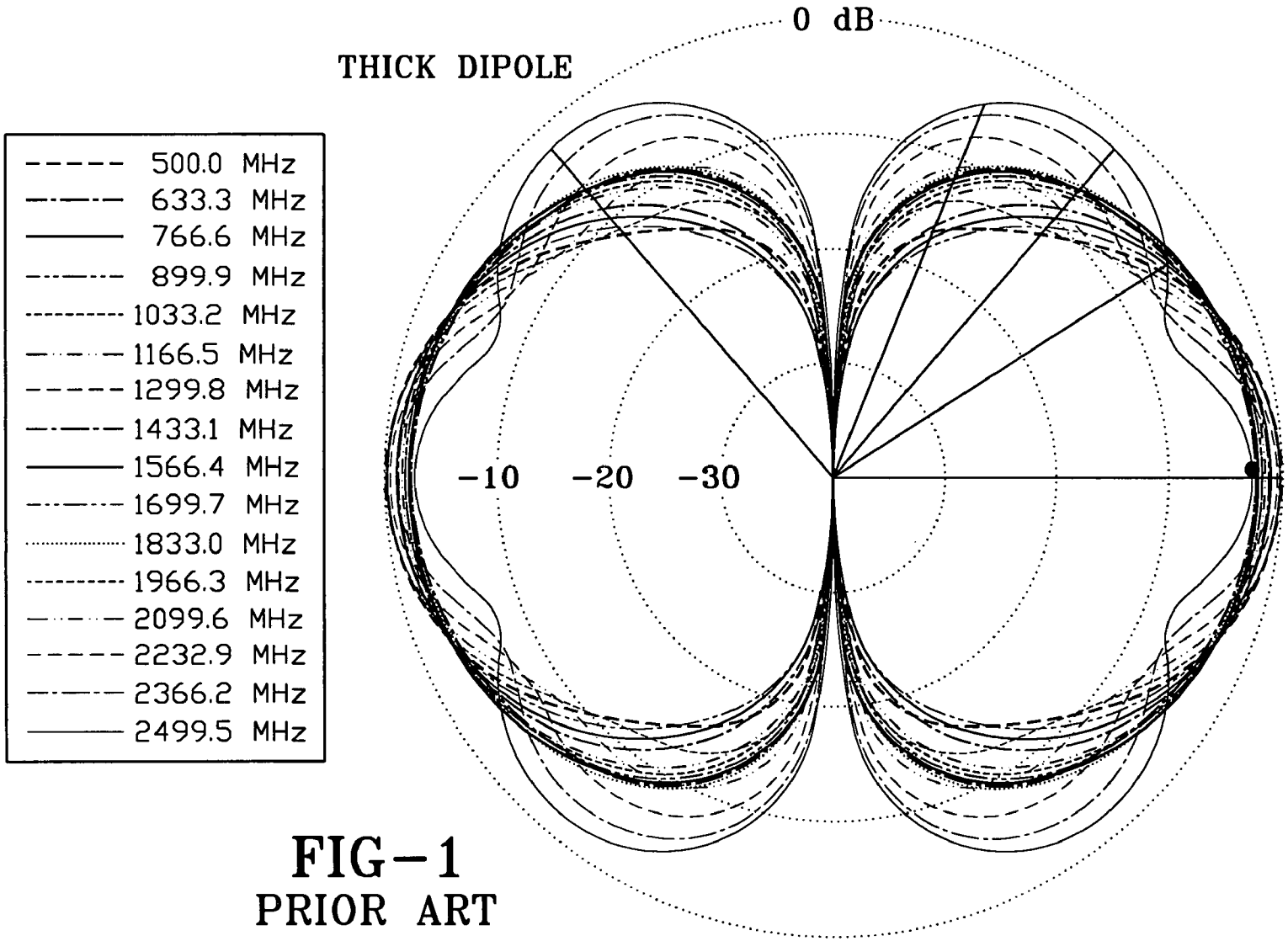
FIG-1 PRIOR ART
FIG. 1 is a plot of a computer simulated frequency response of a prior art 1,990 MHz dipole antenna.
Figure 2:
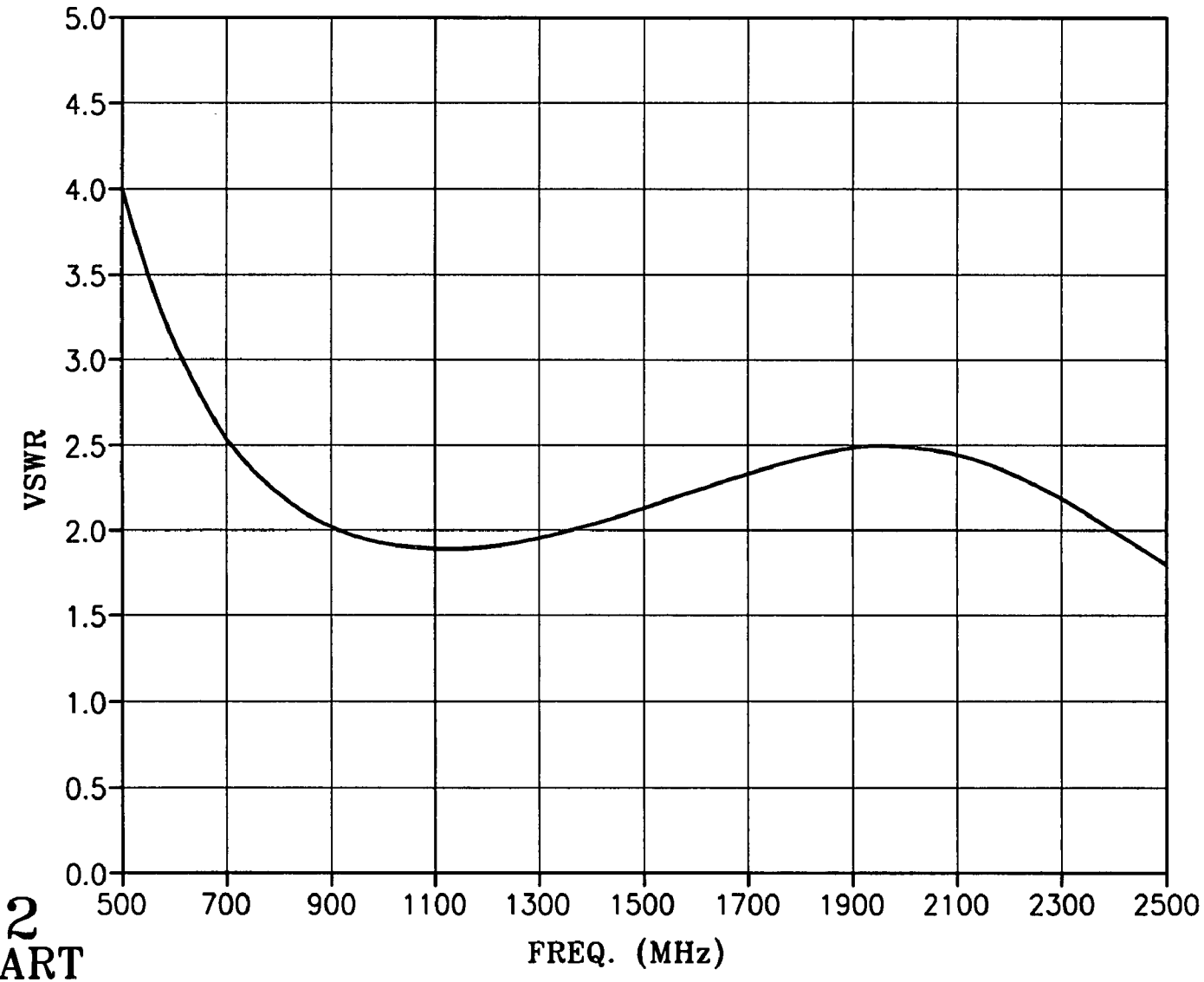
FIG-2 PRIOR ART
FIG. 2 is a plot of the computer-simulated VSWR versus frequency graph of the prior art dipole antenna.
Figure 3:
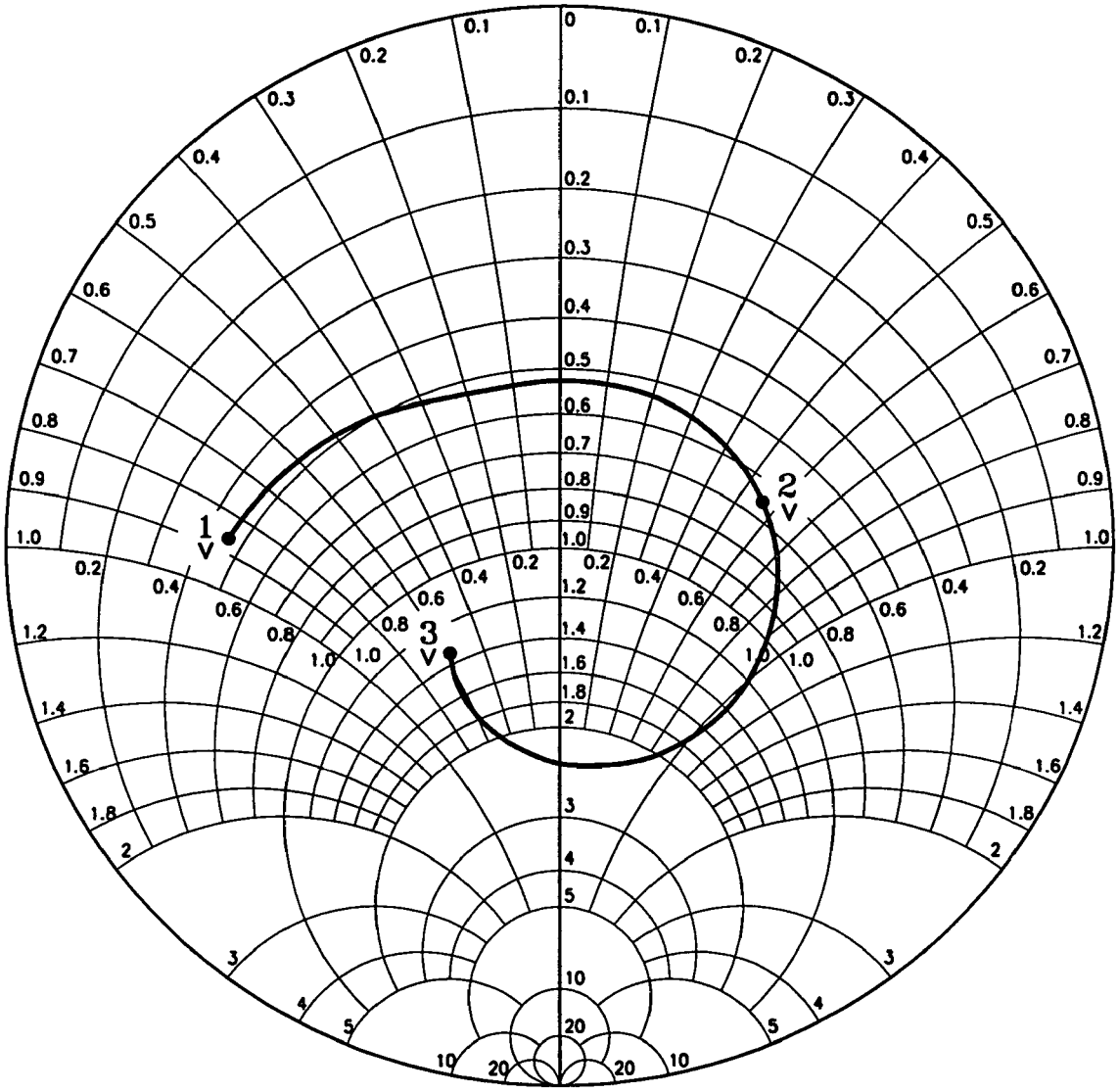
FIG-3 PRIOR ART
FIG. 3 is a computer-simulated plot of a Smith chart of the prior art dipole antenna construction.
Figure 5:
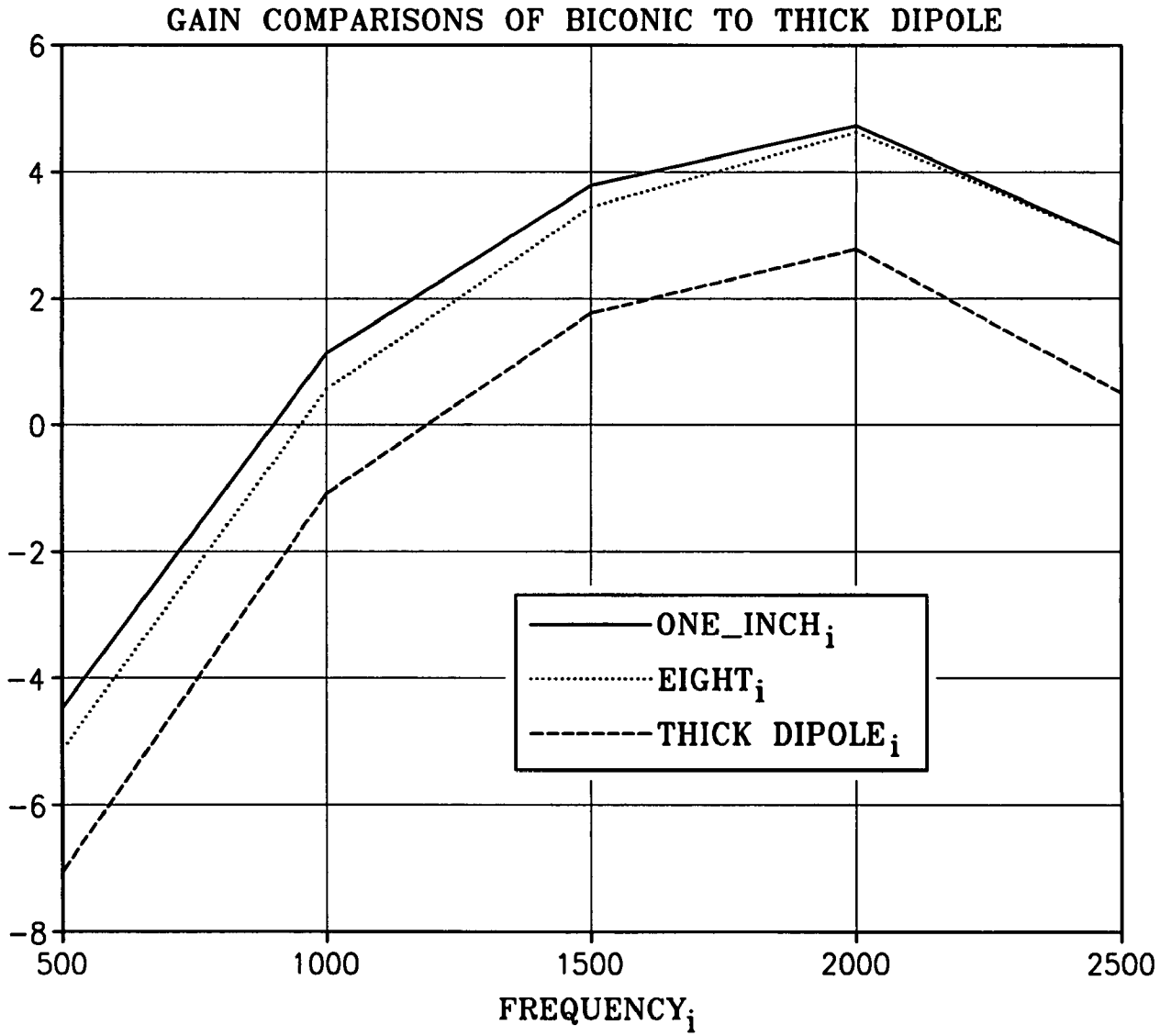
FIG. 5 is a plot of the gain comparisons between the biconical antenna shown in FIG. 4 with a prior art dipole antenna.
Figure 6:
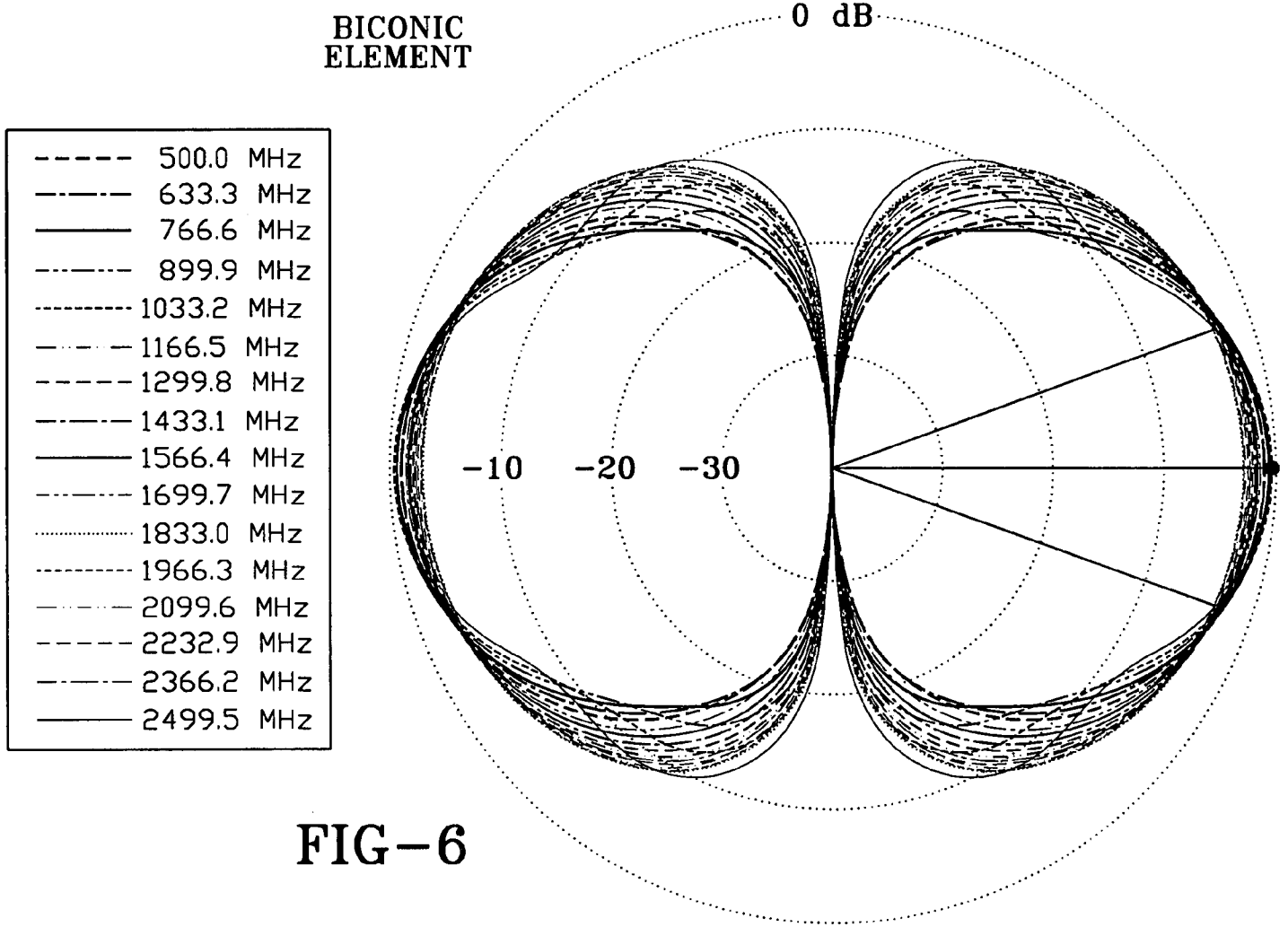
FIG. 6 is a plot of a computer-simulated frequency response of the biconical antenna.
Figure 7:
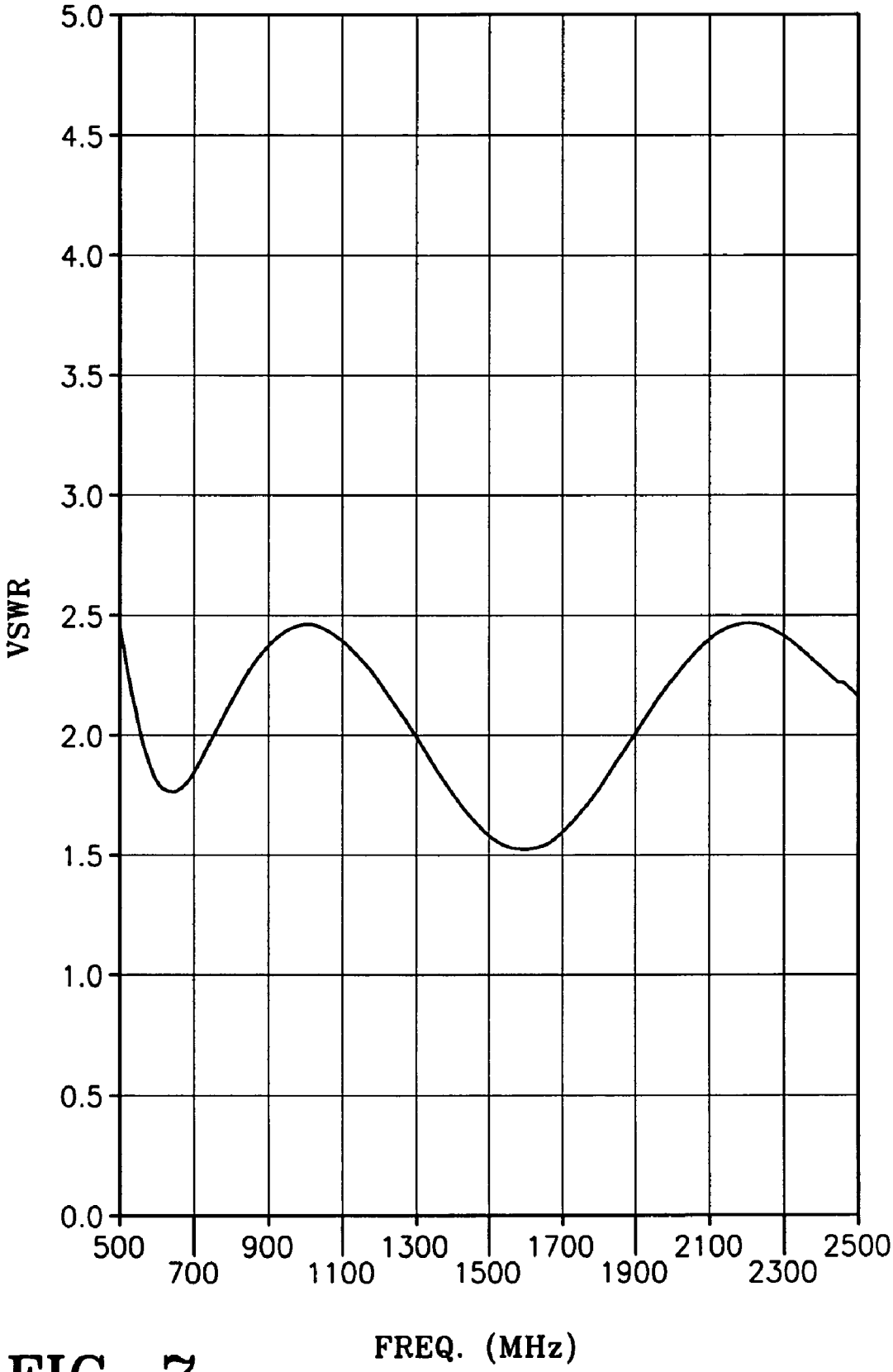
FIG. 7 is a plot of the computer-simulated VSWR versus frequency graph of the biconical antenna.
Figure 8:
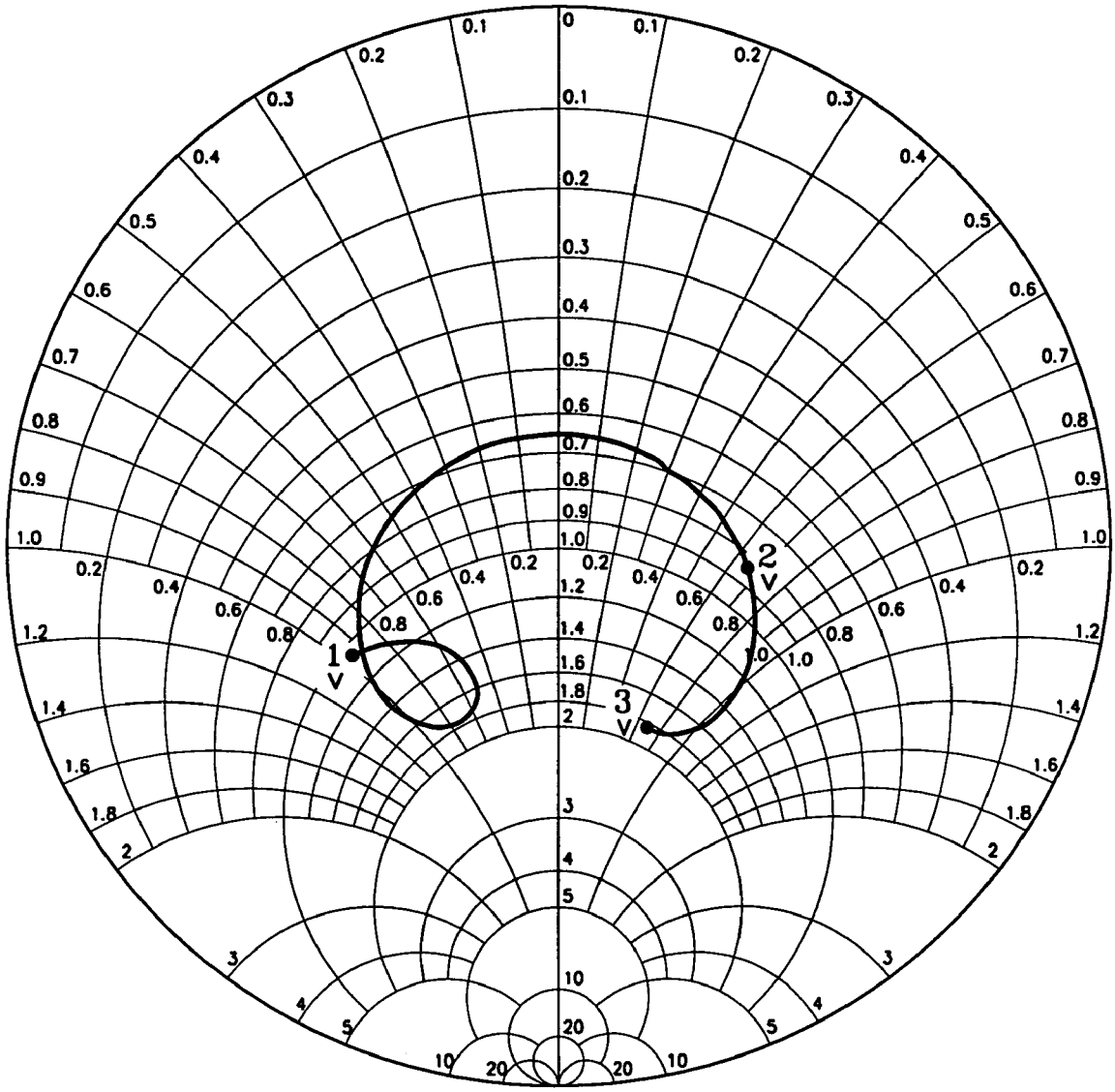
FIG. 8 is a computer-simulated Smith chart of the biconical antenna.

Referring now to FIGS. 5-8 it can be seen that the performance characteristics of the biconical antenna as compared with the thick dipole antenna are readily apparent. In particular, FIG. 5 shows that the biconic antenna at the one inch and 4/5 inch position show that the response characteristics over the frequency range of 500-2500 MHz is significantly improved. This is further is evidenced in FIG. 6 which illustrates that the overall gain is greatly improved and that the elevational peak maintains a desired uniformity over the frequency band of interest especially when compared to FIG. 1. FIG. 7 shows the improved voltage standing wave ratio performance over the range of frequency inasmuch as the VSWR value does not exceed 2.5 over the range of interest and is well below the specified or desired range of 3.0:1.0. And finally, FIG. 8 illustrates that the overall frequency range of the antenna, as shown in the Smith chart, is greatly improved at the lower frequency end in that the end frequencies fold in for a better match.

There are many advantages in the construction and implementation of the wide band biconical antenna 20. Namely, the antenna 20 utilizes smaller half-angles than normally seen in biconical antennas and as such this improves the forward azimuth (horizon) gain, when vertically oriented. Further, it has been found that a narrow "neck" as practical is beneficial for the useful bandwidth performance of the antenna. The electrical characteristics of the input terminal or entry conic provide for efficient communication systems performance, and have desirable attributes such as to allow for a simple matching system. Thus, inherent losses and more complicated matching circuit topologies are avoided. Additionally, the antenna structure disclosed herein can be made to flex allowing for use with man-pack radio communication sets. By utilizing a biconical construction, the present invention counteracts the current nulling effects found in thick dipole antennas such that the distributing out of phase energy created by the current reversal is "phase" corrected to add coherently to the energy leaving the antenna at the horizon or at 0° (s) elevation. Accordingly, the preferred angle θ—9°—appears to phase correct the otherwise uncorrected bifurcation experienced with dipole antennas. This phase correcting feature usefully extends the apparent operating bandwidth of the antenna in terms of desired near-field radiation characteristics. It is believed that the overall effect of the two conic surfaces provided by the entry conic and the termination conic make piece wise curvilinear surfaces suitable for localized phase correction. As such, the otherwise destructive phase fronts created by the now electrically too long antenna structure are thus compensated for by the shape of the conics.

Figure 9:
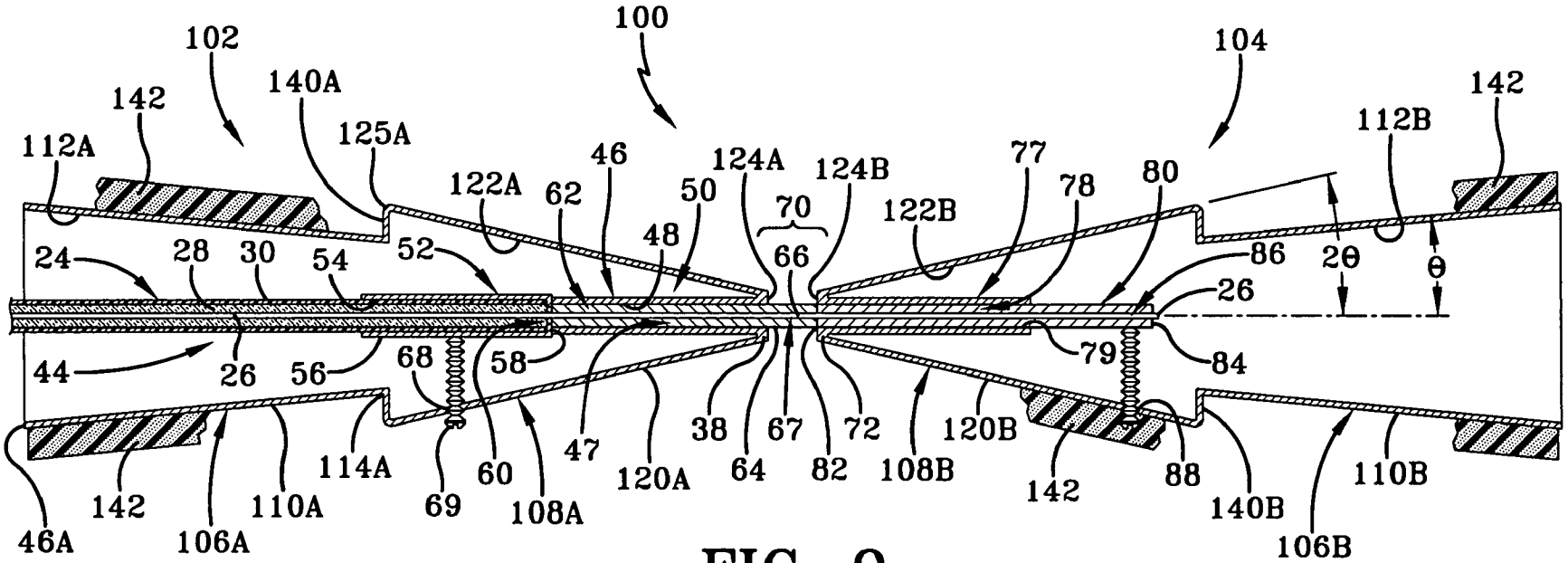
FIG. 9 is a cross-sectional elevational view of a double biconical antenna with a transmission system made according to the concepts of the present invention.

Referring now to FIG. 9 a double biconical antenna which further improves the bandwidth extension is designated generally by the numeral 100. The double biconical antenna 100 includes an entry conic 102 and a termination conic 104. The double biconical antenna 100 is of a similar construction as the biconical antenna 20 where the primary difference is that sub-conics are employed for both the entry conic and the termination conic. Indeed, the internal construction of the double biconical antenna 100 is similar to the biconical antenna 20 in that a matching system is employed and a similar type transmission line is received therein. Since both the entry conic 102 and the termination conic 104 are of a similar construction, the similar components will be identified with an alphabetic suffix. In particular, any elements shown in FIG. 9 which have a capital A letter suffix are associated with the entry conic and anything with a capital letter B suffix will be associated with the termination conic. Any components which have commonality with the antenna 20 will be identified with the same number. Each conic includes a narrow entry conic 106 and a wide entry conic 108. The narrow entry conic 106 is provided with the same half-angle configuration as the conical antenna 20, namely, a 9° plus or minus 2° half-angle. The wide entry conic 108 has a half-angle value that is about twice as much as that of the narrow conic 106. The relevance of this doubling of the half-angle will be discussed in detail in the description below. In any event, the narrow entry conic 106 includes an exterior surface 110 and an interior surface 112. The entry conic 106 has an end 114 opposite an entry edge 116. In other words, the conic tapers inwardly at the 9° half-angle from the entry edge 116 to the end 114. The tapered end of the 106 narrow entry conic is effectively received within the wide entry conic 108 which includes an exterior surface 120 and an interior surface 122. The wide entry conic has an end 124 which carries an eyelet 46 at the entry vertex 38. The walls of the wide entry conics 120A and 120B have a screw hole extending therethrough for positioning the matching system 50 and the cap 80 respectively.

A bridge 140 may connect the narrow entry conic end 114 to the wide entry conic 108 at an edge 125. As in the previous embodiment, the conics are formed from a brass material, although it will be appreciated that any other metallic material could be used. And as in the previous embodiment, a metalized polymeric material could be used to assist in the flexibility of the antenna while maintaining the performance thereof. The transmission line 24, which is connected to an exemplary transmitter/receiver 22, enters the entry conic 102 and the outer conductor 30 and dielectric 28 are configured such that the outer conductor is mechanically and electrically secured to the matching system 50 and in particular to the sleeve 52. The center conductor 26 of the transmission line extends through the insulator 62 which extends out the vertex 124A and contacts the vertex 124B of the termination conic 104. The center conductor extends through the insulator into the cap 80 which is secured to the wide entry conic of the termination conic 104.

It has been found that incorporating a foam material 142 around the wide and narrow entry conics facilitates the performance of the antenna 100. The dielectric foam material 142 maybe disposed in "stepped" layers to enhance the performance characteristics of the antenna. In other words, each layer of foam may have different dielectric properties. And as in the embodiment shown in FIG. 4, the foam material may extend the entire length of the antenna and be enclosed by a radome. Further, it has been found that inclusion of the bridge 140 between the narrow entry conic and wide entry conic 108 also improves performance. Indeed, a rolled edge at the bridge area also seems to provide a benefit.

In addition to the benefits enumerated in regard to the biconical antenna 20 similar benefits are realized in the double biconic antenna 100. Indeed, the double biconic antenna provides a further bandwidth extending technique by superposition of the "sub-conics" which share a common voltage gap with the original "outer" conics. It is believed that enclosing the wide entry conic 108 with foam prevents an energy robbing and pattern disruptive parasitic cavity structure that is created that otherwise occurs when using a hollow undercut sub-conic. It is also believed that the best performance of such a structure is one that follows a relationship of $n*\theta$ where n is an integer and wherein $\theta$ is the outer conic's half-angle. Additionally, the sub-conic's larger circle should be about the same end diameter of the original outer conic. In other words, the diameter of the end 125 should be substantially equal to the outer diameter of the entry edge 116. It has been observed that the peak gain of the biconical antenna is higher than the double-biconical antenna. However, the double biconical antenna 100 provides better upper band gain roll-off characteristics as would be expected. It has also been found that the resulting gap impedance of a double biconical antenna 100 seems to be the approximate superposition of the two separate biconical gap impedances that the double biconical consists of. Departure from a perfect linear superposition may be due to mutual coupling between the collocated conics. This is fortuitous in that the typical one section impedance matching transition is still available for use with this construction. And the geometric mean is smaller because of this superposition of the gap impedances. Although a double biconical construction is shown in this figure and described herein, it is believed that a triple-biconical or a higher number of sub-conics within an entry conic and termination conic may be practical. It is further believed that the half-angle provided by such a construction would be an integer multiplied by the $\theta$ or outer conic's half-angle value.

Figure 10:
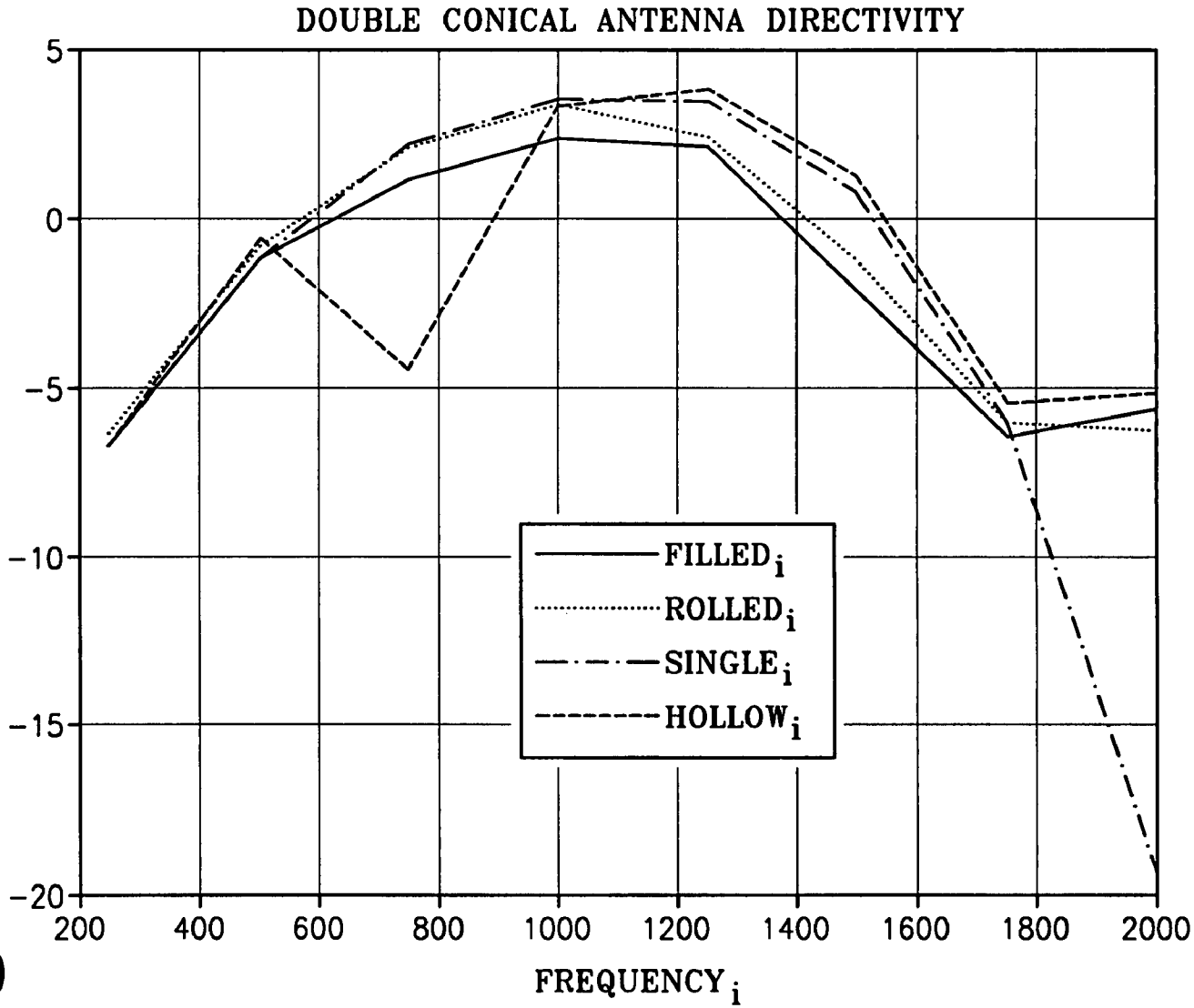
FIG. 10 is a plot of the gain comparisons between the double biconical antenna shown in FIG. 9 with a prior art dipole antenna.

One advantage of the double-biconical antenna can be seen in FIG. 10 which shows characteristics of a filled radome double-biconical antenna as opposed to an unfilled radome. The benefits are clearly evidenced at the frequency range of 600 MHz to about 1,000 MHz which shows the significant differences in the gain values. However, it can be seen that the filled version provides much better operating characteristics over the entire range of frequencies. Further, the rolled embodiment provides much better gain characteristics at the higher end of the frequency range.

Figure 11:
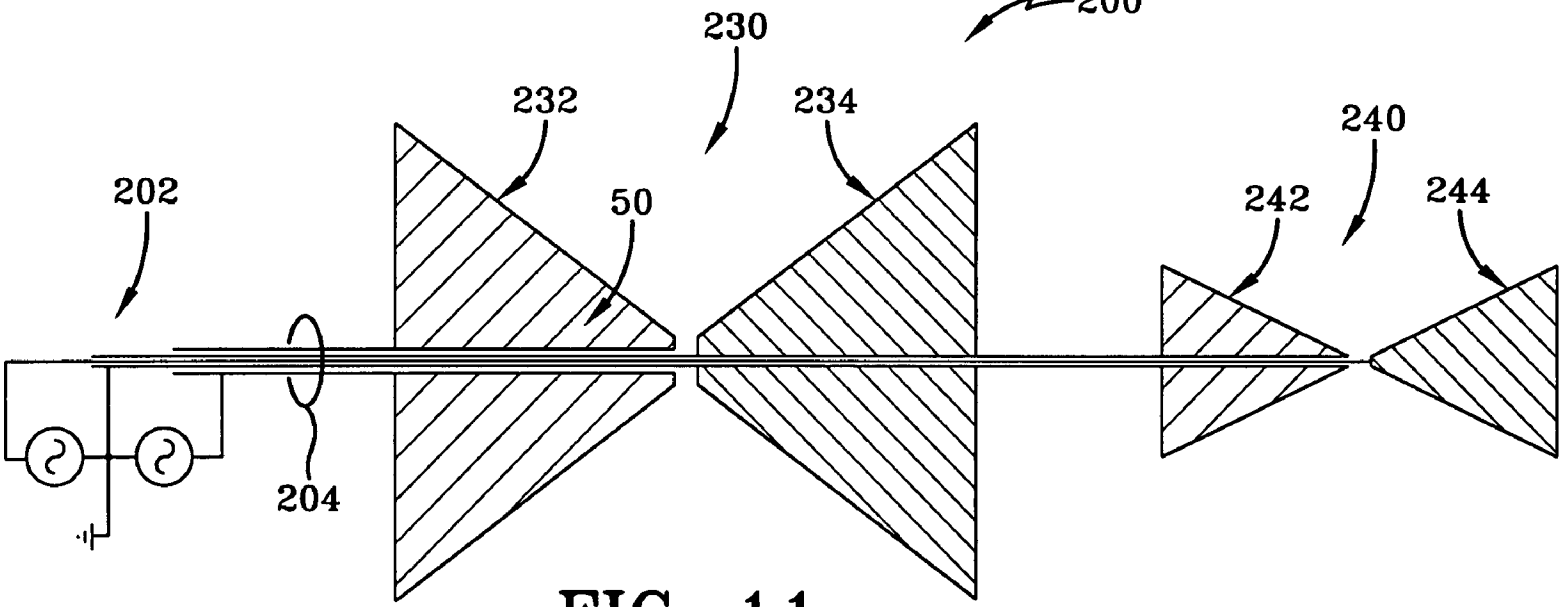
FIG. 11 is a schematic diagram of a stacked biconical antenna made according to the concepts of the present invention.

Referring now to FIG. 11, it can be seen that another embodiment of the biconical antenna may be realized and is designated generally by the numeral 200. This embodiment is a co-linear stacked biconical antenna. In much the same manner as the previous embodiments, a transmission system 202 is coupled to the antenna 200 to allow for improved frequency response performance. Implementation of a co-linear stacked biconical antenna necessitates the need for additional conductors to be provided in the transmission line. Accordingly, if a double stacked biconical antenna is to be constructed, that is two antennas stacked in a linear relationship with one another, an additional conductor for the transmission line is required. Accordingly, with a double stacked biconical antenna a triaxial feed 204 is required. However, it is believed that additional biconical antennas could be co-linearly stacked upon one another by the corresponding addition of a conductor in the transmission line. In any event, the triaxial feed 204 includes an outer jacket 210 that surrounds an outer shield 212 which may be a metallic braid or metallic foil construction. The outer shield 212 surrounds an outer insulation 214 which surrounds an inner shield 216. The inner shield 216 may incorporate a metallic braid or foil or combination thereof. The inner shield 216 surrounds an inner insulation 218 which encapsulates a center conductor 220. It will be appreciated that the selection of the shield and insulation materials directly affects the impedance characteristics of the triaxial feed as dictated by the particular end use of the antenna.

The antenna 200 includes a first stage biconical antenna 230 which includes an entry conic 232 and a termination conic 234. The construction of the biconical antenna 230 is similar to that of the biconical antenna 20 shown in FIG. 4.

A second stage biconical antenna 240 is placed in a co-linear relationship with the first stage biconical 230 and is of a construction similar to antenna 20. The second stage biconical antenna also includes an entry conical section 242 and a termination conic 244 in much the same manner as the antenna 20. A potential difference between the biconical antenna 230 and the biconical antenna 240 is the angular or half-angle relationship of each. As can be seen in the FIG. the half-angle of the first stage biconical antenna may be twice that of the second stage biconical antenna. Accordingly, the number of stages utilized may dictate the half-angle of each biconical antenna. But, the first and second stages may also have equivalent or different half-angle values.

Figure 12:
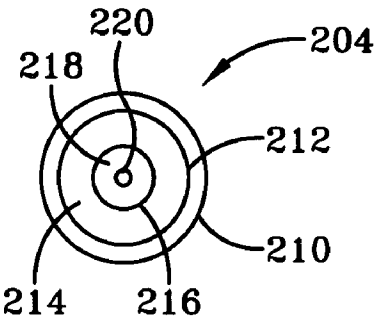
FIG. 12 is a cross-sectional view of an exemplary transmission line used with the antenna shown in FIG. 11.

The triaxial feed 204, shown in FIG. 12, is terminated to the antenna 200 in the following manner. The outer shield 212 is connected to the matching system 50 provided in the first stage biconical antenna 230 and the inner shield and center conductor extend through the termination conic of the first stage biconical and are received in the second stage biconical antenna 240. The inner shield 216 is then terminated to the entry conic 242 of the second stage biconical antenna while the center conductor 220 is terminated to the termination conic 244.

It is believed that the antenna 200 serves the purpose of bandwidth broadening and provide multi-band operation. By placing a smaller higher frequency biconical above a larger lower frequency biconical it is believed that the frequency response and other characteristics of the antenna would be improved. However, since this configuration does not share a common feed point as in the case of a double biconical antenna, the triaxial feed line 204 is required. This will provide for two independent signal paths to the appropriate antenna element. A common potential is shared by the biconical antenna. In other words, the inner shield conductor 216 is common to both the first stage and second stage biconical antennas. As seen in the drawing, the transmission system 202 may be combined by a three port device such as a diplexer which lends itself to further filtering of the received and emitted signals.

Figure 13:
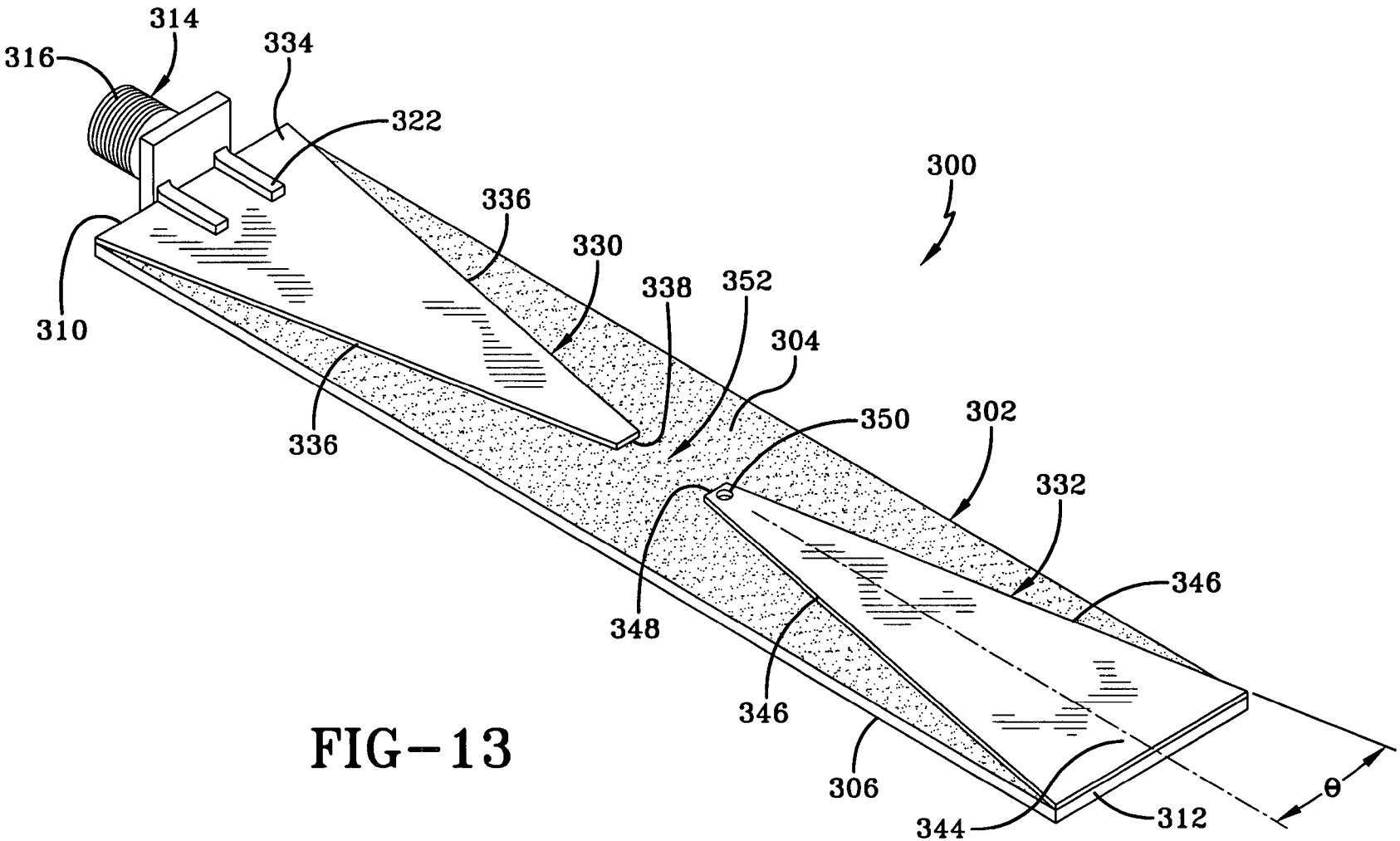
FIG. 13 is a bottom perspective view of a biconical antenna with a transmission system in a two-dimensional configuration.
Figure 14:
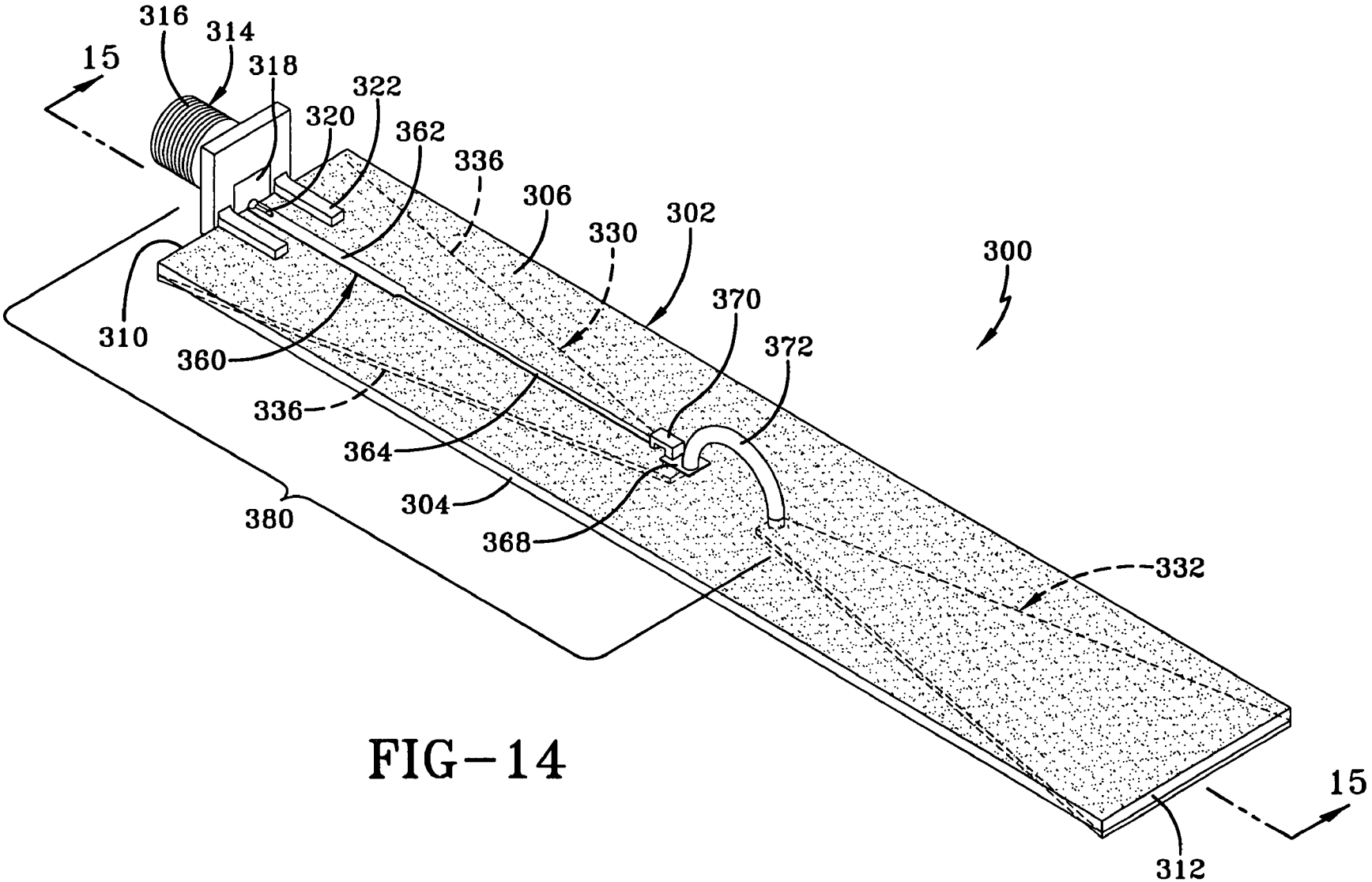
FIG. 14 is a top perspective view of the biconical antenna shown in FIG. 13.
Figure 15:
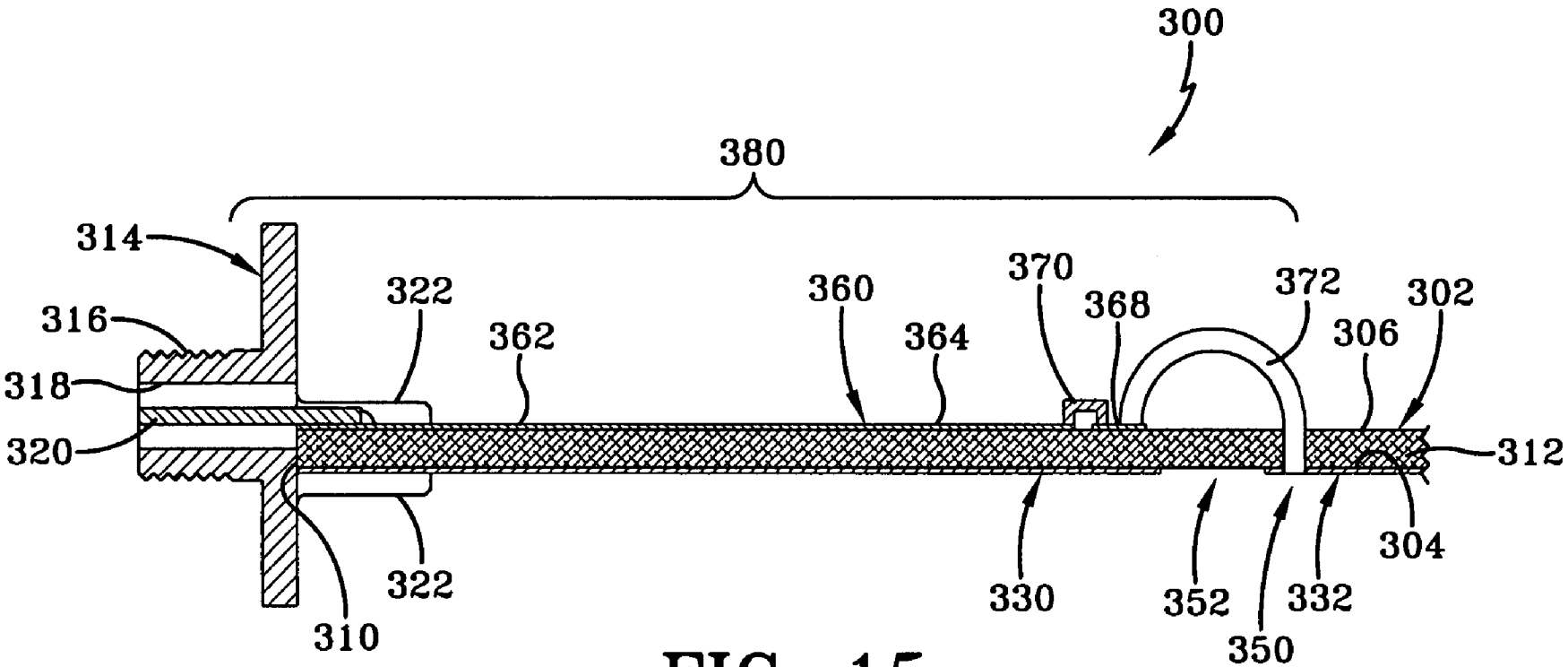
FIG. 15 is a cross-sectional view of the biconical antenna shown along lines 15-15 in FIGS. 13 and 14.

Referring now to FIGS. 13-15, it can be seen that another embodiment of a wide band biconical antenna is designated generally by the numeral 300. The antenna 300 is distinguishable from the other embodiments discussed herein inasmuch as the conics are actually provided in a two-dimensional configuration as opposed to a three-dimensional configuration. As will be discussed, the conics used to generate the desired performance characteristics are provided on a substrate and the antenna is manufactured much like an integrated circuit disposed on a printed circuit board. Briefly, it has been found that such a configuration provides the desired operating characteristics while providing a more compact package that is robust and easy to manufacture.

The antenna 300 includes a substrate 302 which is processed much like a printed circuit board utilized in an integrated circuit assembly. The substrate 302 has a flat rectangular shape, although it will be appreciated that any two-dimensional shape could be utilized. The substrate material may be any non-conductive material such as a glass cloth laminate with an epoxy resin binder such as the common "FR4" circuit board substrate material. Polytetrafluoroethylene (PTFE) "Teflon" with the above glass cloth laminates may also be used as a substrate. The substrate 302 has a planar conic side 304 which is opposite a transmission side 306. The sides 304 and 306 are joined by edges wherein one edge is a connector end 310 that is opposite a distal end 312. Mounted on the connector end 310 is a line connector 314 which may be a SMA, BNC, or any other type of substrate-mountable connector that securably receives a transmission cable such as a coaxial or triaxial transmission line depending upon the end application of the antenna. The connector 314 includes a cable fixture 316 which receives the cable and which terminates the outer shield, or ground, of the cable that is attached thereto. Disposed within the fixture 316 is an insulator 318 which electrically isolates a line socket 320 that is electrically connected to a central or center conductor of the transmission cable. A plurality of mounting tabs 322 extend from the cable fixture 316 for the purpose of securing the connector 314 to the substrate 302.

As best seen in FIG. 13, the conic side 304 has an entry conic designated generally by the numeral 330 and a termination conic designated generally by the numeral 332. The entry conic and termination conic are essentially a layer of metalized material that is disposed on the substrate 302. The metalized material may be tin, copper or any other appropriate conductive material that adheres to or is otherwise secured to the substrate surface. Although any thickness of metallized material can be used, it is believed that a thickness of about 0.0014 inches to 0.0028 inches or 1.4 to 2.8 thousandths of an inch is optimal. And a substrate thickness of 30 to 60 thousandths of an inch is optimal.

The entry conic 330 has an entry base 334 which is disposed proximally adjacent to or at the connector end 310. Extending from the base 334 are a pair of entry sides 336 which are angularly slanted inwardly toward each other and which terminate at an entry vertex 338. The vertex 338 is disposed at about a mid-point lengthwise and widthwise of the substrate 302.

The termination conic 332, which is shaped and manufactured in much the same manner as the entry conic 330, provides a termination base 344 proximally adjacent to or at the distal end 312. A pair of termination sides 346 extend from the termination base 344 and extend inwardly and slant toward one another and are joined with one another at a termination vertex 348. The termination vertex is also disposed at about a mid-point lengthwise and widthwise of the subsrate 302. However, the termination vertex 348 does not come in contact with the entry vertex 338. Disposed through the substrate 302 at the termination vertex 348 is a conic aperture 350. Indeed, the conic aperture 350 extends through the metalized layer and the substrate 302. The termination vertex 348 and the entry vertex 338, although closely or adjacently disposed one another, are not in contact with one another and, as such, provide a vertex gap 352 therebetween.

Both the entry conic and termination conics in this particular embodiment are, in fact, triangle shaped which mimic or imitate the conics shown in the previous embodiments. This triangular shape has been found to provide the operating characteristics of a true conic while still providing the desired operating characteristics. The triangular shapes of the conics 330 and 332, as with the true conics in the other embodiments, provide a half-angle of 9° plus or minus 2°, wherein the half-angle is designated by the symbol θ in FIG. 13. Accordingly, the benefits attributed to the previous embodiments are provided by the antenna 300.

Referring now to FIG. 14, it can be seen that the transmission side 306 includes a microstrip transmission line 360. The line tab 320 is electrically connected to the transmission line 360 by either a mechanical or soldered connection. The transmission line 360 includes a wide section 362 which extends from the connector end 310 and is contiguous with a narrow section 364 which extends toward the entry vertex 338. It will be appreciated that the sections 362 and 364 may be shaped in any manner to create a matching transformer function in a manner similar to the coaxial counter-part of the three-dimensional bi-conic antennas previously described. It will further be appreciated that the microstrip transmission line 360 is centered within an envelope defined by the entry sides 336. In other words, the triangle shape of the conic 336 is effectively bi-sected by the transmission line 362. Accordingly, the transmission line is disposed within a ground plane formed by the entry conic and is essentially coaxially aligned with the entry conic in much the same manner as in the previous embodiments.

Spaced apart from the distal end of the narrow section 364 is a transmission pad 368. An inductor chip 370 is connected between the narrow section 364 and the transmission pad 368. The inductor chip 370 is used in conjunction with the microstrip transmission line 360 to form a complete matching system. A wire loop 372 has one end connected to the transmission pad 368 by soldering or a mechanical joint and wherein the other end of the wire loop 372 is directed through the conic aperture 350 and electrically connected to the termination conic 332. The wire loop 372 allows for excitation of the antenna and hole by transmitting energy from the microstrip/matching system. In other words, the center conductor of the coaxial transmission line that is mounted upon the connector 314 is directed through the transmission line 360, the inductor chip 370, the wire loop 372 and then is electrically connected to the vertex of the termination conic 332.

A matching system 380 is collectively formed by the microstrip transmission line, the transmission pad 368, the inductor chip 370 and the wire loop 372. The matching system 380 is positioned so that it is effectively "received" in the entry conic 332, although it is disposed on the other side of the substrate. It will be appreciated that the shaping of the transmission line controls the characteristic impedance of the transmission line and allows for fine tuning of the matching system to provide the desired antenna operational characteristics. And the present construction allows for sizing of the respective bases 334, 344 and vertices 338, 348 to be equivalent to the dimensions D1 and D2 ratios referred to in the previously disclosed embodiments. Accordingly, the desired operational characteristics of the antennas can be maintained, but in a more compact and easy to manufacture package. Indeed, the operating characteristics of the antenna 300 shown in FIGS. 13-15 are substantially the same as the antenna shown in FIG. 4. Accordingly, the operating characteristics of the antenna 300 are substantially represented by the characteristics shown in FIGS. 5-8. If desired, the antenna 300 may be enclosed in a radome or other outer covering to protect the components of the antenna. Another benefit of the substrate construction disclosed in this embodiment is that the sub-conic configurations shown in FIG. 9 and the stacked bi-conic configuration shown in FIG. 11 with the appropriate modifications evident to those skilled in the art may be embodied on a substrate. Such a configuration would consist of a multi-layer circuit board with the following layers: cladding; substrate; cladding; substrate; cladding. The outer cladding would make up two independent microstrip lines, while the center cladding would be shaped to form the two separate bi-conic elements. The upper bi-conic element would be connected via a standard coaxial line to the new microstrip on one side of the bigger bi-conic.

Based upon the foregoing, the advantages of the present invention are readily apparent. The biconical antenna in the original form, in a double biconical form, a stacked co-linear relationship, or in any of these forms embodied in a printed circuit board substrate provides for extending bandwidth and improved overall gain characteristics. The use of a matching system in the entry conics of the antennas provides for a radio frequency choke for the purpose of isolating the antenna structure from its feed transmission line or other radio communication apparatus. The invention is further advantageous in that the selected narrow or tiny 9° half-angle or angle substantially sized thereto provides for phase correction which usefully extends the operating bandwidth in the terms of far-field radiation characteristics. With this construction it will be appreciated that the antennas can be used for diverse military applications inasmuch as the conics may be constructed by electro-depositing a conductive film onto a semi-pliable carrier. Accordingly, this carrier would have the requisite form of the conical shapes and once plated with the conductive material, the same electrical functionality as a rigid structure made from copper or brass. Moreover, such a construction could be placed in a flexible tube, capped and connectorized to complete the antenna assembly. The resulting assembly would then be installed onto a radio communication set such as a "man pack." It is believed that the performance of such a device would allow for the replacement of the common "rubber duck" antennas now used and yet be smaller than the 1 meter ribbon antenna that is also commonly used, while still improving the electrical performance of the antenna.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A wideband antenna comprising:

a non-conductive substrate having a conic side opposite a transmission side;

a transmission line disposed on said transmission side; and at least two effective conics disposed on said conic side and spaced apart from each other, said transmission line disposed within a ground plane formed by one of said conics and connected at an end to one of the other of said conics.

2. The antenna according to claim 1, wherein said at least two effective conics comprise:

an entry conic having an entry vertex; and a termination conic having a termination vertex, said conics axially aligned with each other and said vertices having a vertex gap therebetween.

3. The antenna according to claim 2, further comprising:

a network connected to said transmission line.

4. The antenna according to claim 3, wherein said network is selected from a group consisting of a resistor, an inductor, a capacitor, and combinations thereof.

5. The antenna according to claim 3, wherein said network is disposed within said ground plane.

6. The antenna according to claim 2, wherein said termination conic and said substrate have a conic aperture therethrough.

7. The antenna according to claim 6, further comprising:

a wire having one end connected to said transmission line, and an opposite end directed through said conic aperture and connected to said termination conic.

8. The antenna according to claim 2, wherein said entry conic and said termination conic each have a half-angle of about 9 degrees plus or minus 2 degrees.

9. The antenna according to claim 1, further comprising:

a line connector having a ground connection connected to one of said conics and a line tab connected to said transmission line.

10. The antenna according to claim 9, wherein said line tab is axially oriented with respect to said conics.

11. The antenna according to claim 1, wherein said transmission line is sized to provide a desired resistance value.

12. The antenna according to claim 1, further comprising:

a matching system which includes said transmission line which is effectively received in an axial orientation with respect to said entry conic to transform an impedance value of said transmission line to a desired impedance value.

13. The antenna according to claim 1, further comprising:

a line connector having a ground connection connected to one of said conics and a line tab connected to said transmission line, such that said line tab is axially oriented with respect to said conics.

14. The antenna according to claim 1, wherein said at least two effective conics comprise:

an entry conic having an entry vertex opposite an entry base;

a termination conic having a termination vertex opposite a termination base;

wherein said entry conic is bounded by entry sides that extend continuously from said entry vertex to said entry base, and wherein said termination conic is bounded by termination sides that extend continuously from said vertex to said termination base.

15. The antenna according to claim 14, wherein said conics are axially aligned with each other.

16. The antenna according to claim 1, wherein the antenna has an instantaneous bandwidth of 500 to 2500 MHZ with a Voltage Standing Wave Ratio of 3.0 or less.

* * * * *

UNITED STATES PATENT AND TRADEMARK OFFICE

CERTIFICATE OF CORRECTION

PATENT NO. : 7,339,529 B2
APPLICATION NO. : 11/223576
DATED : March 4, 2008
INVENTOR(S) : Gary A. Martek It is certified that error appears in the above-identified patent and that said Letters Patent is hereby corrected as shown below:

In Column 13, line 13 (Claim 8, line 1) the number "2" should read --1--.

Signed and Sealed this

Twenty-fourth Day of June, 2008

JON W. DUDAS
*Director of the United States Patent and Trademark Office*